US012096907B2

(12) United States Patent
Weinstock

(10) Patent No.: US 12,096,907 B2
(45) Date of Patent: Sep. 24, 2024

(54) VACUUM

(71) Applicant: Marc Frederick Weinstock, Los Angeles, CA (US)

(72) Inventor: Marc Frederick Weinstock, Los Angeles, CA (US)

(73) Assignee: Pickup Bricks LLC, Sherman Oaks, CA (US)

( * ) Notice: Subject to any disclaimer, the term of this patent is extended or adjusted under 35 U.S.C. 154(b) by 12 days.

(21) Appl. No.: 17/560,158

(22) Filed: Dec. 22, 2021

(65) Prior Publication Data

US 2022/0202263 A1 Jun. 30, 2022

Related U.S. Application Data

(60) Provisional application No. 63/132,314, filed on Dec. 30, 2020.

(51) Int. Cl.

| | |
|---|---|
| ***A47L 9/14*** | (2006.01) |
| ***A47L 5/36*** | (2006.01) |
| ***A47L 7/00*** | (2006.01) |
| ***A47L 9/00*** | (2006.01) |
| ***A47L 9/22*** | (2006.01) |
| ***A47L 9/24*** | (2006.01) |
| ***A63H 33/30*** | (2006.01) |

(52) U.S. Cl.

CPC ..... *A47L 9/1409* (2013.01); *A47L 5/365* (2013.01); *A47L 7/0085* (2013.01); *A47L 9/009* (2013.01); *A47L 9/22* (2013.01); *A47L 9/248* (2013.01); *A63H 33/305* (2013.01)

(58) Field of Classification Search

CPC ..... A47L 9/009; A47L 9/14; A47L 9/1409; A47L 9/22; A47L 9/248; A47L 5/365; A47L 7/0085; A47L 9/1683; A47L 9/1463; A63H 33/305; B07B 13/003; B07B 13/00; B07B 13/04

USPC ..... 209/132, 133, 142, 659, 643; 206/8

See application file for complete search history.

(56) References Cited

U.S. PATENT DOCUMENTS 2,766,842 A * 10/1956 Hurd ..... A47L 9/1427 55/508
3,365,864 A * 1/1968 Iizima ..... A47L 9/125 55/471
3,413,779 A * 12/1968 Koike ..... A47L 9/2894 192/30 R (Continued)

FOREIGN PATENT DOCUMENTS

FR 2844697 A1 * 3/2004 ..... A47L 5/365

OTHER PUBLICATIONS

PE2E Translation FR-2844697; Kim, Ki; Wet and Dry Vacuum Cleaner Includes Short Cylindrical Body with Dirt and Liquid Separator Mounted Above Electric Motor; Mar. 26, 2004 (Year: 2004).*

*Primary Examiner* — Tom Rodgers
*Assistant Examiner* — Sidney D Full

(57) ABSTRACT

A cleaning device includes a suction motor; a hose in communication with the suction motor; a first receptacle that is configured to communicate with the hose and to collect at least one first object outside of the cleaning device; a second receptacle that is configured to communicate with the first receptacle and to collect at least one second object outside of the cleaning device; wherein the at least one second object is smaller than the at least one first object; and a third receptacle that is configured to nest with the first receptacle and the second receptacle.

14 Claims, 9 Drawing Sheets

(56) References Cited

U.S. PATENT DOCUMENTS

| | | | | |
|---|---|---|---|---|
| 5,522,908 | A * | 6/1996 | Frey | B01D 46/02 55/380 |
| 7,077,399 | B2 * | 7/2006 | Yamagishi | G07D 9/00 273/148 R |
| 7,165,289 | B1 * | 1/2007 | Gossage | B65G 53/24 15/314 |
| 7,676,884 | B2 * | 3/2010 | Mayes | A47L 9/1427 15/352 |
| 8,182,564 | B2 * | 5/2012 | Howard | B01D 46/02 55/482 |
| 8,689,983 | B1 * | 4/2014 | Ripley | B07B 4/08 15/418 |

* cited by examiner

VACUUM

CROSS REFERENCE TO RELATED APPLICATION

This application claims priority to and the benefit of U.S. Provisional Patent Application No. 63/132,314, filed Dec. 30, 2020, the entirety of which is incorporated herein by reference.

BACKGROUND OF THE DISCLOSURE

In homes, care facilities, and schools with young children, adults often struggle with small toys left out on the floor. Most young children have not developed the skills necessary to properly put their toys and other items away, and they do not particularly enjoy the act of cleaning up. Many toys for young children are small and tedious for adults to put away, for example, LEGOS® and other small toys and figurines.

Adults often need to be creative and make clean up a game to engage children. However, there are still constraints on how much a child can be involved, as it is not advisable to have children using appliances and other cleaning apparatuses made for adult use. Additionally, cleaning apparatuses intended for adults are typically meant for a mess that is to be discarded, rather than for toys, and toys are often damaged if picked up by adult cleaning apparatuses, such as vacuums. Nonetheless, the art of cleaning up is an important life skill that all children need to master.

For these reasons, it is surprising that there is a limited selection of toys available that engage and educate children with respect to the process of cleaning up. Accordingly, there is a need for a toy that is fun, engaging, and safe for children to use and that is capable of picking up small toys from surfaces. Ideally this toy would also be educational and easy for kids to use.

BRIEF SUMMARY

In one aspect of the present disclosure, a cleaning device comprises a motor; a plurality of receptacles configured to: communicate with the motor; collect, via vacuum, objects of different sizes from outside of the cleaning device; and reversibly nest and unnest with one another.

In another aspect of the present disclosure, a cleaning device comprises a suction motor; a hose in communication with the suction motor; a first receptacle that is configured to communicate with the hose and to collect at least one first object outside of the cleaning device; a second receptacle that is configured to communicate with the first receptacle and to collect at least one second object outside of the cleaning device; wherein the at least one second object is smaller than the at least one first object; and a third receptacle that is configured to nest with the first receptacle and the second receptacle.

In a further aspect of the present disclosure, a cleaning device comprises a base; a suction motor in the base; a hose in communication with the suction motor; a lid that is configured to connect to the base; a first receptacle that is configured to nest in the lid and to communicate with the hose; a second receptacle that is configured to nest in the base and to communicate with the first receptacle; and a third receptacle that is configured to nest in the base and to communicate with the second receptacle.

Other systems, methods, features, and advantages of the present disclosure will be, or will become, apparent to one with skill in the art upon examination of the following detailed description. It is intended that all such additional systems, methods, features, and advantages be included within this description, be within the scope of the present disclosure, and be protected by the following claims.

DRAWINGS

DETAILED DESCRIPTION

Figure 1:
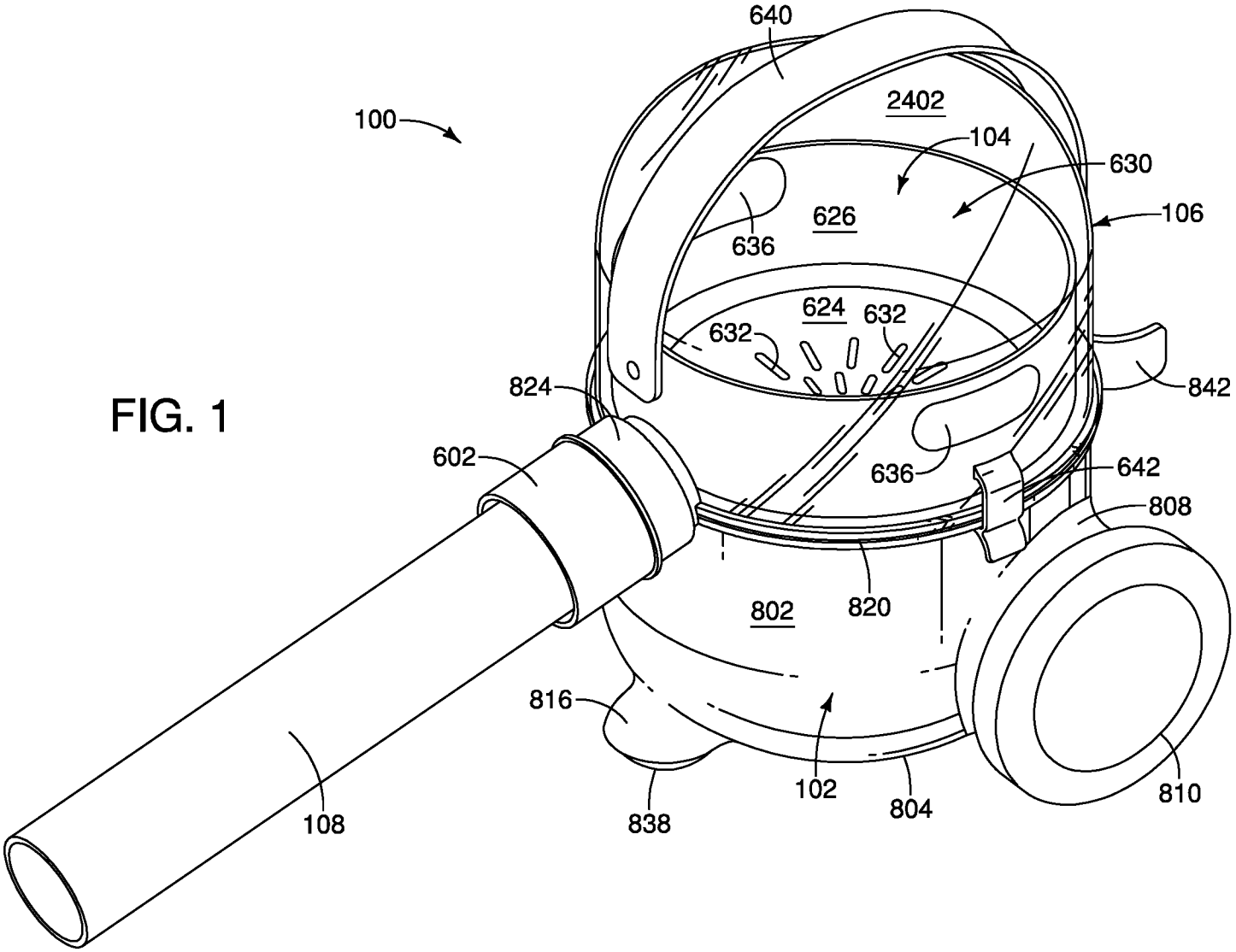
FIG. 1 is a perspective view of a cleaning device according to an exemplary aspect of the present disclosure.
Figure 2:
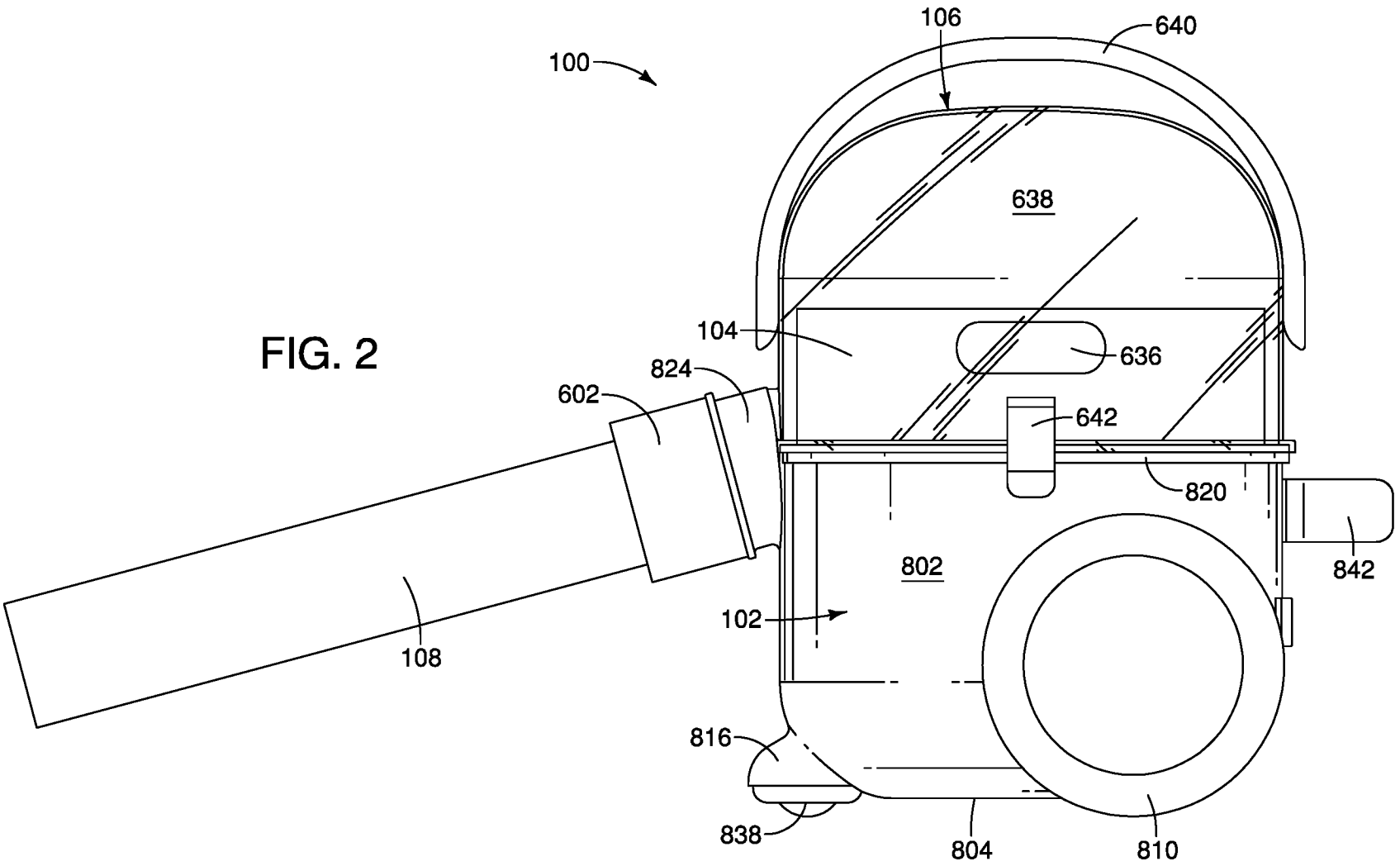
FIG. 2 is a side, plan view of the cleaning device of FIG. 1.
Figure 3:
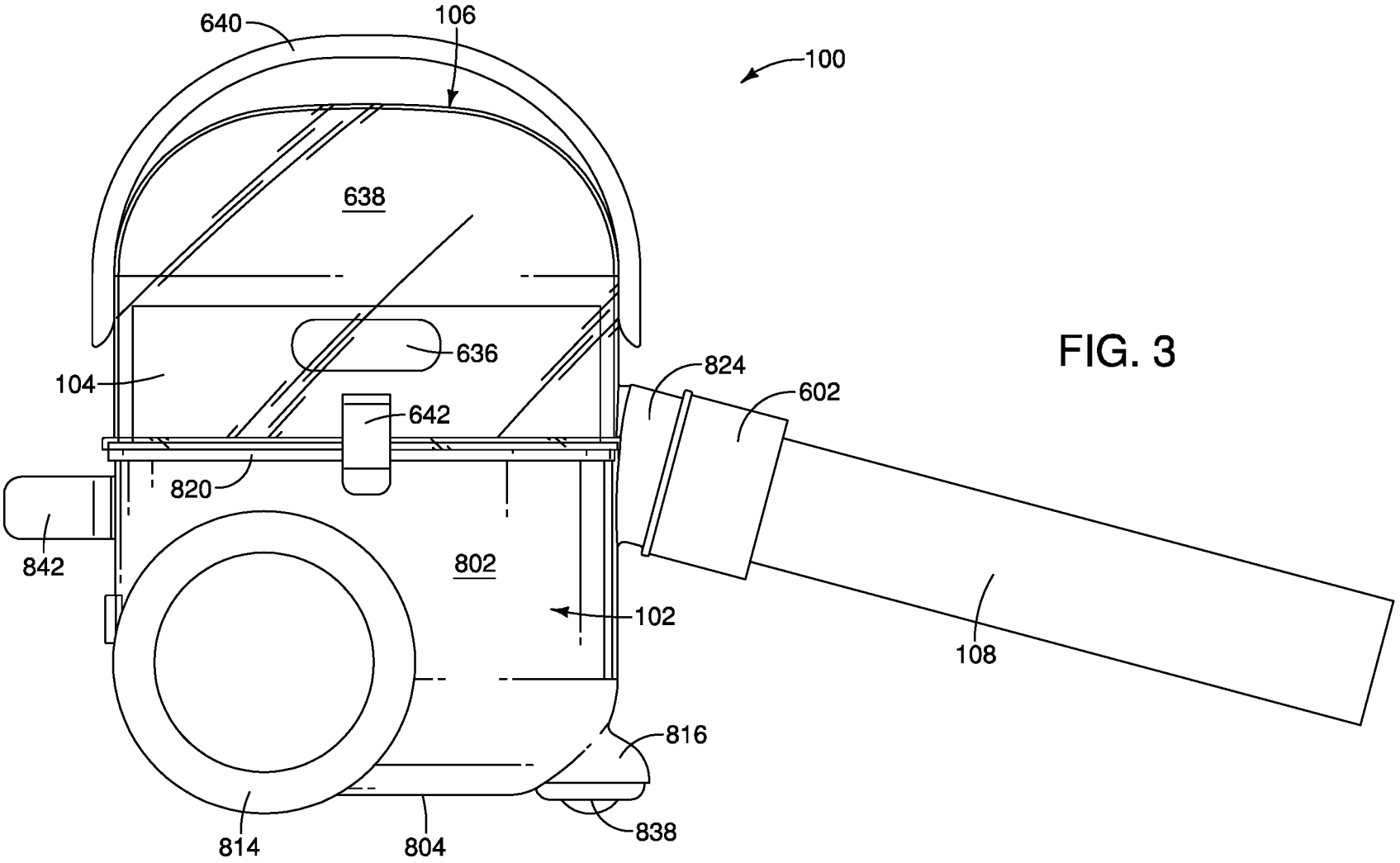
FIG. 3 is another side, plan view of the cleaning device of FIG. 1.
Figure 5:
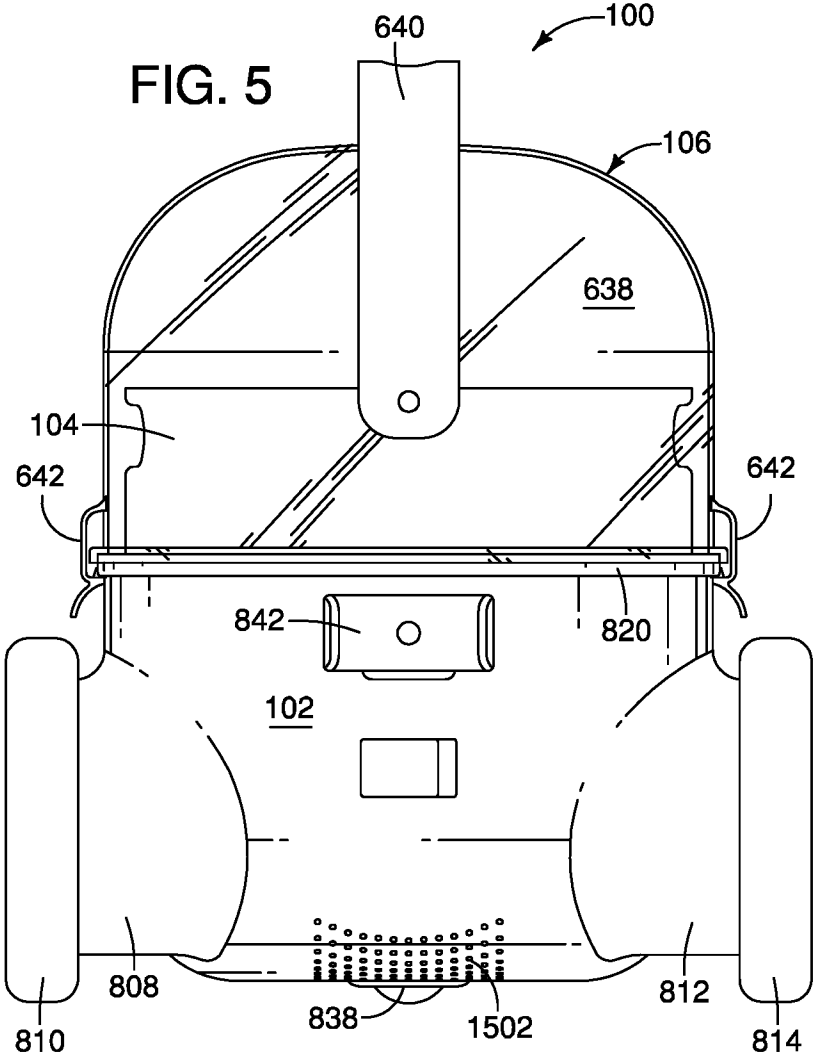
FIG. 5 is a rear, plan view of the cleaning device of FIG. 1.
Figure 4:
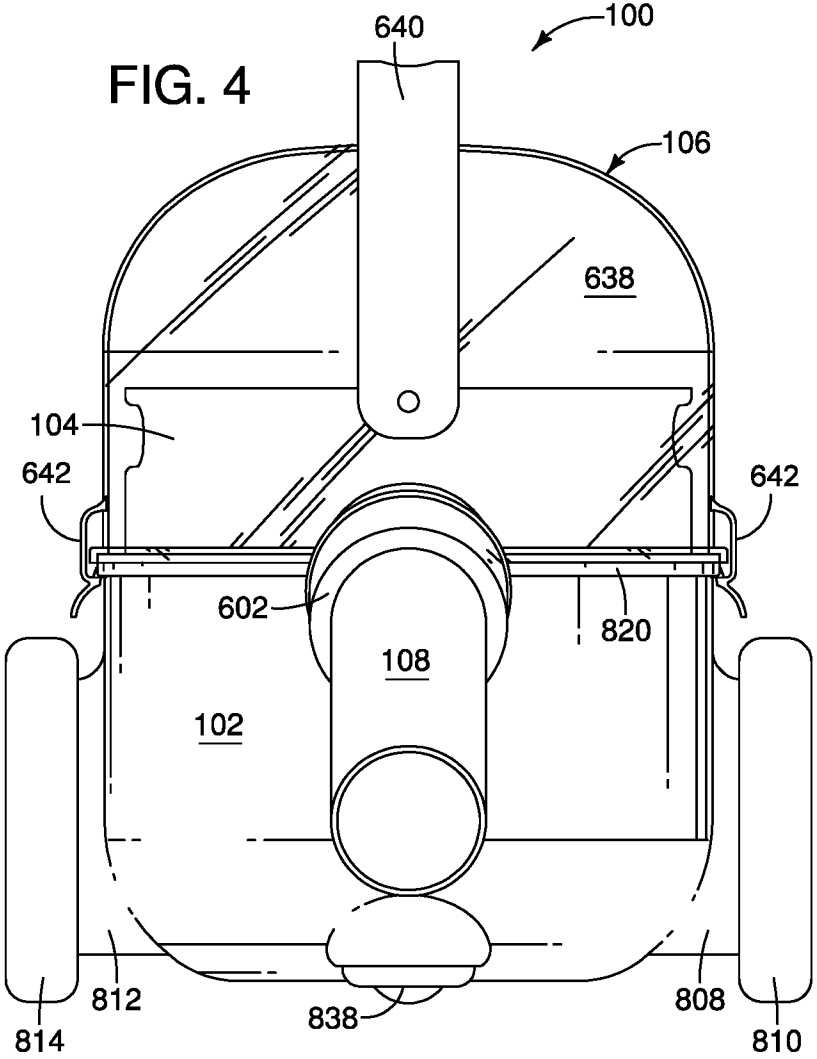
FIG. 4 is a front, plan view of the cleaning device of FIG. 1.
Figure 6:
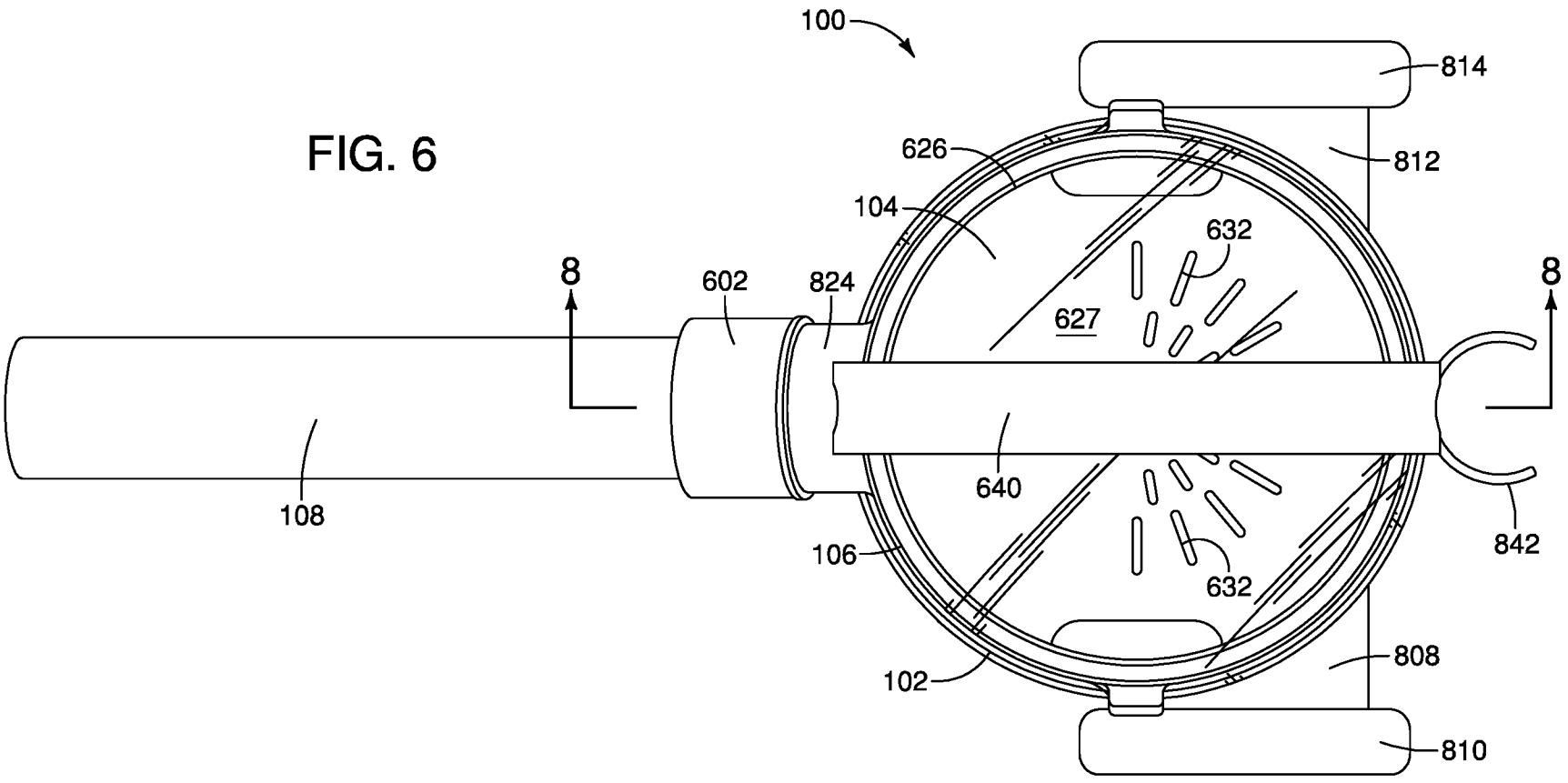
FIG. 6 is a top view of the cleaning device of FIG. 1.

In the following description, for the purposes of explanation, numerous specific details are set forth in order to provide a thorough understanding of the claimed subject matter. It may be evident, however, that the claimed subject matter may be practiced without these specific details.

The following description of the various systems and methods is not intended to limit the inventive systems and methods disclosed herein to one variation, but rather to enable any person skilled in the art of making cleaning devices to make and use the inventive systems and methods.

As used herein, the terms "aspect" and "aspects" are used interchangeably. Therefore, the singular refers to the plural, and vice versa.

Generally, the problem to be solved herein is the need for a cleaning device (i.e., vacuum) that is suitable for children yet still able to function as a cleaning device while teaching children how to clean up after themselves, such as their toys.

The present disclosure solves the foregoing problem by providing a cleaning device (i.e., vacuum) that can include a suction motor in a base, and a hose connected to the base. The base may support a plurality of receptacles that may reversibly nest and unnest with one another. One or more of the plurality of receptacles may collect objects of different sizes, via vacuum and the hose, and separate the larger collected objects (e.g., toys) from the collected smaller objects (e.g., trash or dust). A lid may cover the plurality of receptacles when the user is vacuuming up the objects. The lid may be removed so that the user may access and continue to use the objects.

In FIGS. 1-7, an exemplary cleaning device (i.e., vacuum) 100 according to aspects of the present disclosure is shown. The cleaning device 100 can be easy to use by children. The cleaning device 100 can be fun, engaging, and educational for children. The cleaning device 100 can also be safe for children to use.

The cleaning device 100, according to aspects of the present disclosure, may be fabricated from any material such as plastic, as a non-limiting example, or any combination of materials. In certain aspects of the present disclosure, the cleaning device 100 may be fabricated from a rigid, lightweight material allowing the cleaning device 100 to be durable and portable.

In aspects of the present disclosure, the cleaning device 100 can be configured to vacuum up both large and small objects that are outside of the cleaning device 100. In others aspect of the present disclosure, the cleaning device 100 may be further configured to sort large and small objects after they have been vacuumed up.

As shown in FIGS. 1-7, according to aspects of the present disclosure, the cleaning device 100 can have a base 102, a first receptacle 104 (among a plurality of receptacles), a lid 106, a hose 108, and wheels 810, 814, 838. As shown in FIGS. 8-12, according to aspects of the present disclosure, the cleaning device 100 can further have a second receptacle 620, a third receptacle 604, a motor 846, and a power source 848.

As can be appreciated by those skilled in the art, the foregoing components of the cleaning device 100, as well as other components of the device 100 described below, may be separate components, integral with one another, or a combination thereto. It can be appreciated by a skilled artisan that there can be many suitable materials, sizes, shapes, configurations, and manufacturing methods for the cleaning device 100 and its components.

Referring to FIGS. 1-7, and as noted above, the cleaning device 100 may include a base 102. The base 102 of the cleaning device 100 may generally support and/or house the other components of the cleaning device 100. In aspects of the present disclosure, the base 102 may support the plurality of receptacles 104, 604, 620, such as in a nesting orientation.

The base 102 may include a sidewall 802 and a bottom portion 804. The sidewall 802 may be cylindrical in shape. The sidewall 802 and the bottom portion 804 may be separate components or integral with one another. The sidewall 802, in combination with the bottom portion 804, can define a cavity FIG. 12, 806 in the base 102. The sidewall 802, in combination with the bottom portion 804, may have a bowl-like configuration, according to an aspect of the present disclosure. However, one skilled in the art may select any suitable shape and configuration for the base 102.

In an aspect of the present disclosure, the base 102, such as the sidewall 802, may further include a clamp 842 (e.g., a U-shaped hose clamp) disposed thereon. The clamp 842 may be integral with the sidewall 802 or connected to the sidewall 802 using any suitable connecting means, such as a plate and screw combination, as a non-limiting example. The clamp 842 may hold the hose 108 in a stored position when the hose 108 is not in use.

Figure 7:
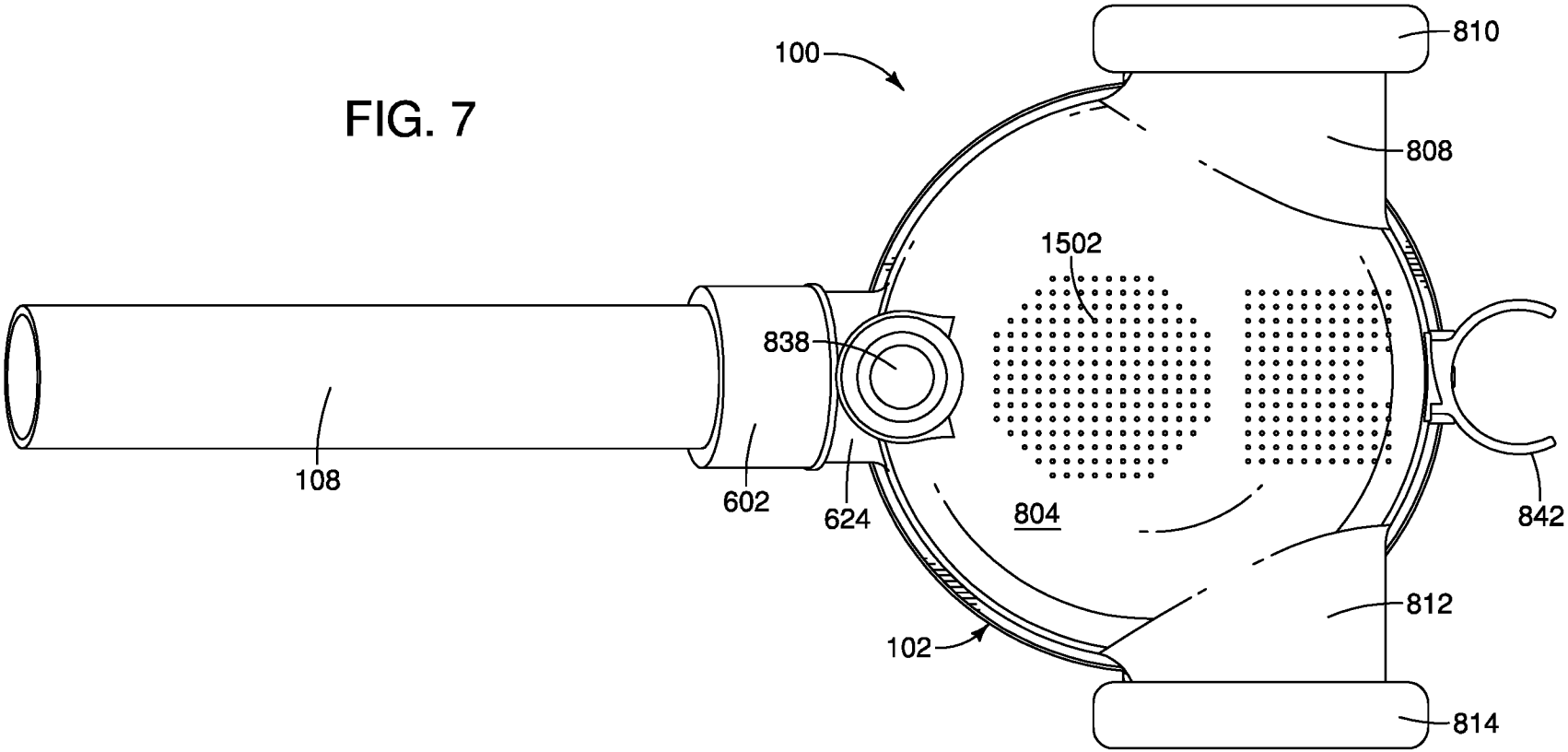
FIG. 7 is a bottom view of the cleaning device of FIG. 1.

In an aspect of the present disclosure, the base 102, such as the bottom portion 804, may include one or more vent holes FIG. 7, 1502. The vent holes 1502 may provide a means for the discharge of air from the motor 846 in the base 102, as further described below.

In various aspects of the present disclosure, the base 102 can include a first opening 808 configured to receive a first wheel 810. The base 102 can further include a second opening 812 configured to receive a second wheel 814. The first and second openings 808, 812 may be disposed in the sidewall 802, the bottom portion 804, or a combination of the sidewall 802 and the bottom portion 804, of the base 102. The base 102 can further include a third opening 816 disposed in the bottom portion 804 and configured to receive a third wheel (e.g., a ball wheel) 838.

In other aspects of the present disclosure, additional openings, wheels, and ball wheels may be included. Likewise, one skilled in the art may select any suitable configurations for any number of openings, wheels, or ball wheels. In other aspects, other means of stabilizing and moving the cleaning device 100 may be selected.

The base 102, according to an aspect of the present disclosure, may include a top edge 820 which may include a semi-circular groove disposed in the sidewall 802. A sidewall extension 824 may be cylindrical in shape and may extend outwardly from the groove, in certain aspects of the present disclosure. The sidewall extension 824 can be configured to connect, optionally via a connector 602, to the hose 108, as further described below.

Still referring to FIGS. 1-7, and as noted above, the cleaning device 100 may include a hose 108. The hose 108, according to aspects of the present disclosure, can be used to collect (via vacuum) objects outside of the cleaning device 100. The collected objects may include toys, trash, and dust. In certain aspects of the present disclosure, the collected objects may be of different sizes. In certain aspects of the present disclosure, the collected toys (such as LEGO® bricks) may be larger than collected trash and dust.

The hose 108 may be configured to be in air and/or vacuum communication with the cavity 806 of the base 102 and/or with the motor 846 described below. In certain aspects of the present disclosure, the hose 108 may releasably connect to the base 102 via the connector 602 and the sidewall extension 824. In various aspects, the hose 108 may also be configured to be in air and/or vacuum communication with the lid 106, the first receptacle 104 and the second receptacle 620 described below.

The hose 108 may include a cylindrical tube that defines an airflow cavity in certain aspects of the disclosure. The cylindrical tube may be extendable and retractable in certain aspects. In other aspects of the present disclosure, a connecting mechanism can be configured to secure the hose 108 to one or more of the base 102, the lid 106, the first receptacle 104, and the third receptacle 604. The connecting mechanism may be a twist and lock mechanism, a snap mechanism, or a friction fit connection, as non-limiting examples. A diverter may be disposed adjacent the connecting mechanism in certain aspects of the disclosure. Alternatively, the diverter may be disposed on the lid 106 adjacent the connecting mechanism of the hose 108.

Still referring to FIGS. 1-7, and as noted above, the cleaning device 100 may include a first receptacle (e.g., tray) 104 that may be configured to collect at least one object (such as a relatively larger object) from outside of the cleaning device 100. The first receptacle 104 may be one of three receptacles, according to aspects of the present disclosure. The first receptacle 104 may be further configured to nest in the second receptacle 620 described below, as well as in the base 102, in various aspects. The first receptacle 104 may also be configured to nest in the lid 106 described below, in various aspects.

Figure 8:
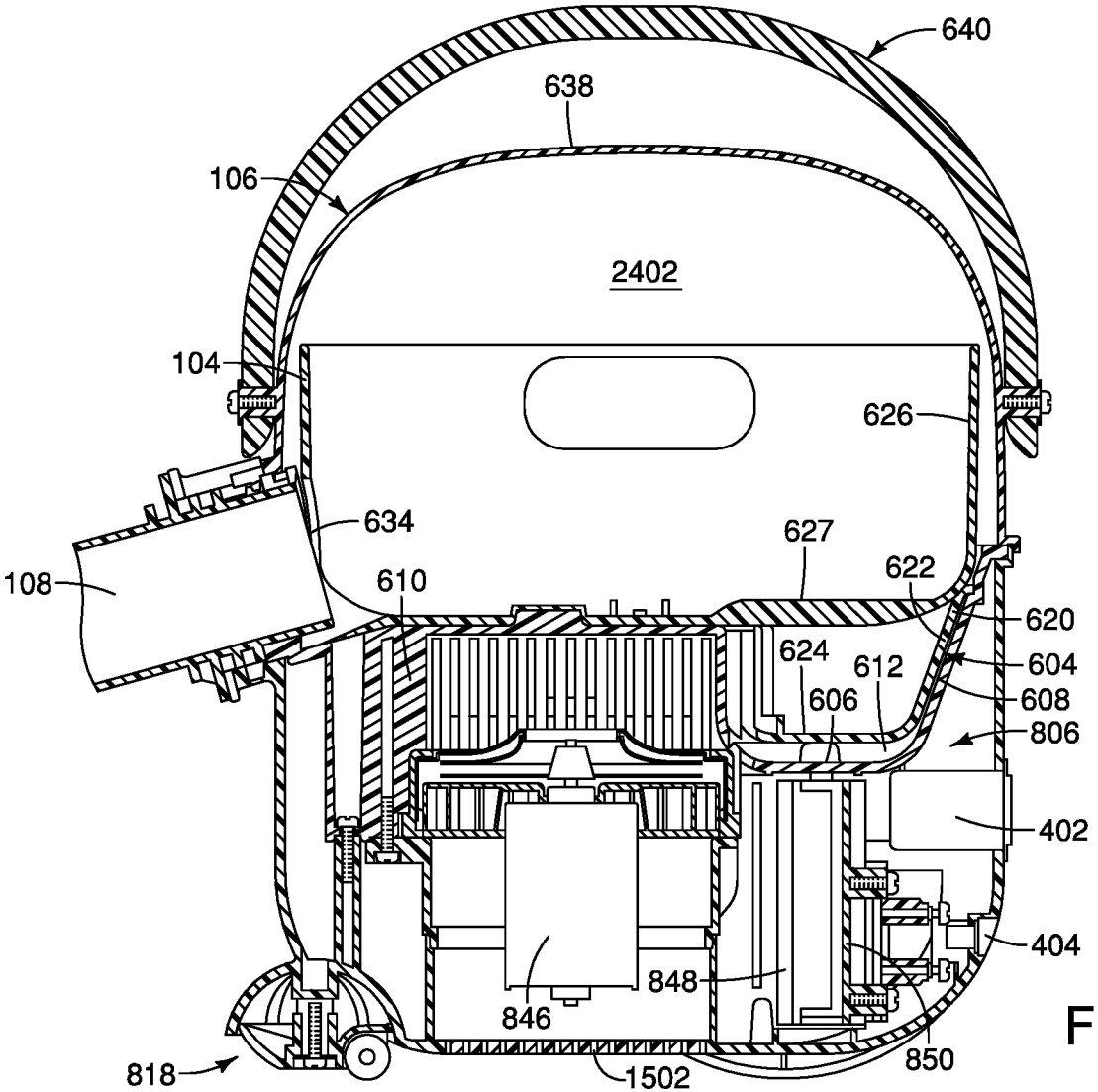
FIG. 8 is a cross sectional view taken along line 8-8 of FIG. 6.
Figure 9:
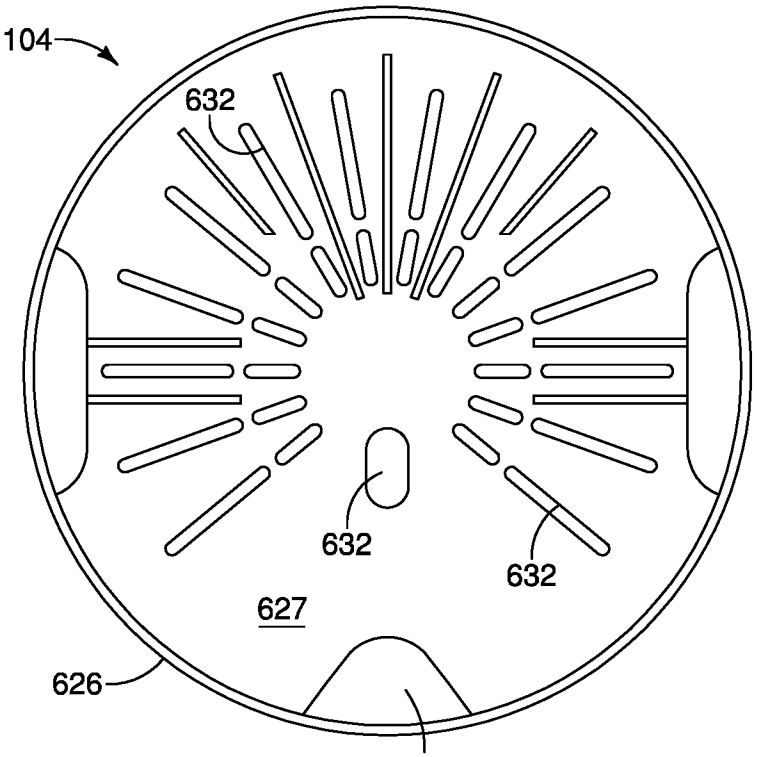
FIG. 9 is a top view of a receptacle of the cleaning device of FIG. 1.

The first receptacle FIG. 9, 104 may have a sidewall 626 and bottom portion 627 that define a cavity 630 therein, according to certain aspects of the present disclosure. The first receptacle 104, and in particular the cavity 630, may be configured to communicate with the hose 108. In aspects of the present disclosure, the sidewall 626 may include a cylindrical opening FIG. 8, 634 that can be configured to receive the hose 108 and/or a sidewall extension 824 described below (FIGS. 8-9). Likewise, the sidewall 626 may include one or more grips FIG. 3, 636 to enable a user to grip and remove the first receptacle 104 from the base 102.

As seen in FIG. 9, the bottom portion 627 of the first receptacle 104 may include a one or a plurality of openings 632, in aspects of the present disclosure. The one or plurality of openings 632 may provide air and/or vacuum communication between the first receptacle 104 and the second receptacle 620.

The one or plurality of openings 632 may also separate different sized collected objects from the hose 108. In certain aspects of the present invention, the one or plurality of openings 632 may be configured and dimensioned to hold within the cavity 630 first collected objects (such as toys) while allowing second collected objects (such as trash and dust) to pass from the first receptacle 104 to the second receptacle 620. The passage of the second collected objects into the second receptacle 620, according to aspects of the present disclosure, may be by gravity and/or vacuum.

Still referring to FIGS. 1-7, and as noted above, the cleaning device 100 may include a lid 106 which may be configured to connect to the base 102. The lid 106 can have a main body 638. In certain aspects, the main body 638 may be in the shape of a dome; however, one skilled in the art may select any desired configuration for the lid 106. The main body 638 can define a cavity 2402 (FIG. 8). A handle 640 may be disposed on the main body 638 of the lid 106 in certain aspects. The lid 106 may include a semi-cylindrical opening 644 in the main body 638 configured to receive the hose 108. The lid 106 may also include one or more connecting elements 642 adapted to form an air-tight seal with the base 102. The connecting elements 642, according to aspects of the present disclosure, may release and unrelease from the base 102 to thereby make the lid 106 removeable from the base 102. Alternatively, the base 102 may include one or more connecting elements 642 that can releasably connect to the lid 106.

In certain aspects, the lid 106 and the first receptacle 104 may be integral with one another. In other aspects, the lid 106 may be made of a transparent material which may allow a user to see objects that have been collected in the first receptacle 104.

As can be appreciated, the lid 106 may be configured to cover and uncover the plurality of receptacles 104, 604, 620. Further, since the lid 106 may be transparent, a user may see when/which collected objects in the first receptacle 104 can be removed from the cleaning device 100. In various aspects, the collected objects can be removed the first receptacle 104, as well as from one or more of the other receptacles 604, 620. To remove one or more of the collected objects from the cleaning device 100 (such as from the first receptacle 104), the connecting elements 642 may be removed from the base 102 and thereby allow the lid 106 to be removed from the base 102. One or more of the receptacles 104, 604, 620 may then be removed from the base 102.

Figure 10:
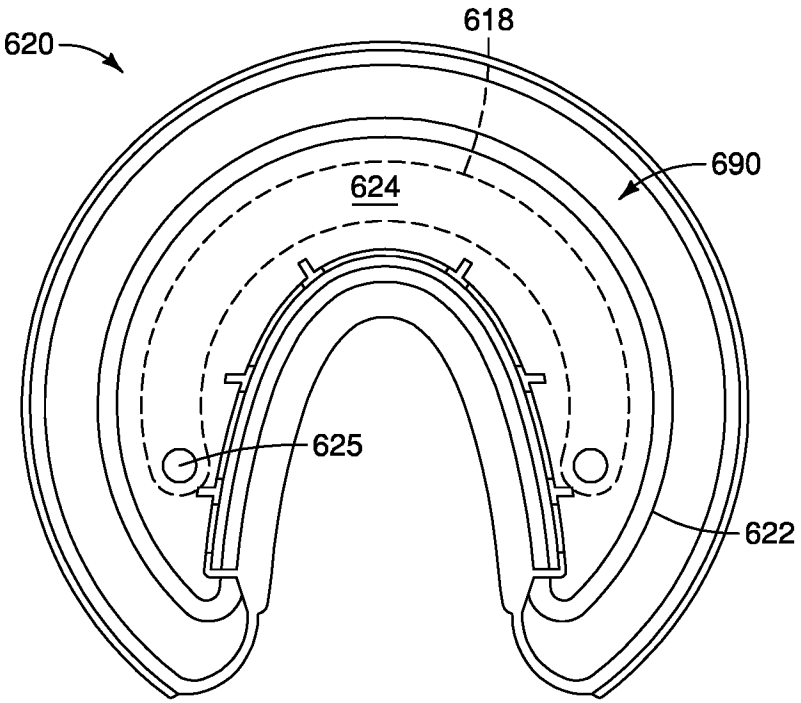
FIG. 10 is a top view of another receptacle of the cleaning device of FIG. 1.
Figure 11:
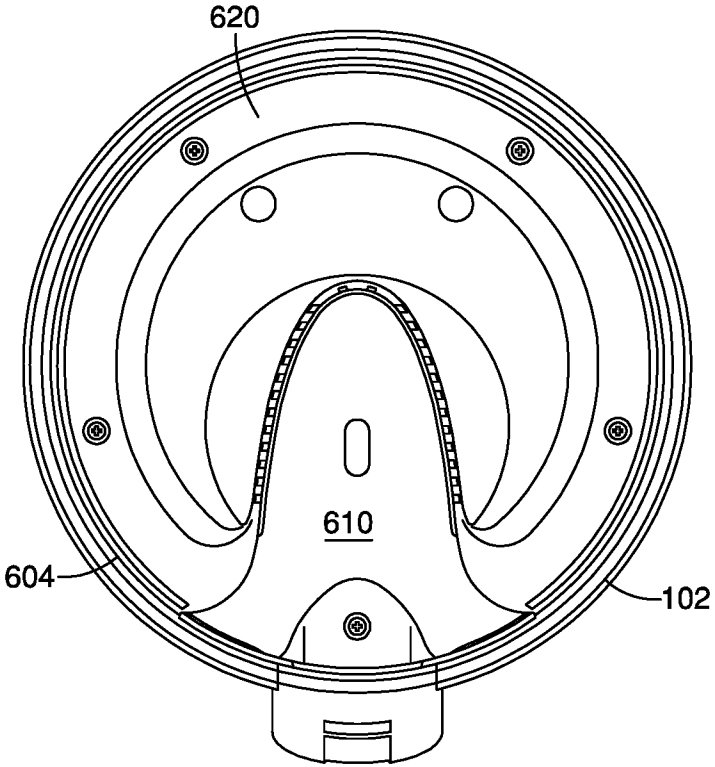
FIG. 11 is a top view of a structural tray of the cleaning device of FIG. 1.

Referring to FIGS. 8, 10 and 11, and as noted above, the cleaning device 100 may include a second receptacle (e.g., tray) 620. The second receptacle 620 can be configured to communicate with the first receptacle 104. In various aspects, the second receptacle 620 can be further configured to collect at least one object (such as a relatively smaller object) from outside of the cleaning device 100. The second receptacle 620 may also be configured to nest in the third receptacle 604, as well as in the base 102. The second receptacle 620 can be configured to removably (i.e., reversibly) nest and unnest with the first receptacle 104 and/or the third receptacle 604, according to aspects of the present disclosure.

In an aspect of the present disclosure, the second receptacle 602 may be configured to receive a motor housing 610 described below. The second receptacle 620 may, in aspects of the present disclosure, include a sidewall 622 and bottom portion 624, both of which may, in combination, form a cavity 690 therein. In an aspect of the present disclosure, the cavity 690 and/or overall shape of the second receptacle 620 may be somewhat U-shaped or horseshoe shaped. In an aspect of the present disclosure, the cavity 690 and/or overall shape of the second receptacle 620 may enable the second receptacle 620 to encircle (partially or completely) a motor housing 610 described below.

The bottom portion 624 of the second receptacle 620 may include one or a plurality of openings 625. The one or plurality of openings 625 may be configured to allow collected objects (such as trash and dust) from outside of the cleaning device to pass from the second receptacle 620 to the third receptacle 604 described below. The passage of the collected objects into the third receptacle 604, according to aspects of the present disclosure, may be by gravity and/or vacuum.

As an alternative to or in addition to allowing collected objects to pass from the second receptacle 620 to the third receptacle 604, a filter 618 may be disposed in the cavity 690 of the second receptacle 620, such as at the bottom portion 624, according to an aspect of the present disclosure. As an alternative to or in addition to a filter 618 disposed in the cavity 690 of the second receptacle 620, a filter 618 may be disposed between the second receptacle 620 and the third receptacle 604, such as on a surface of the bottom portion 624 that faces the third receptacle 604, according to an aspect of the present disclosure.

The filter 618, according to certain aspects, may be a piece of paper with an adhesive quality. The adhesive quality may be a glue, as a non-limiting example. Alternatively, the adhesive quality may be static electricity or any other suitable adhesive. A person skilled in the art may select any material and adhesive component for the filter 618. In alternate aspects, a user may select a different filter, such as a HEPA filter, a sponge filter, or any other type of filter suitable for allowing air to flow through the second receptacle 620 while collecting dirt and debris, as desired.

Referring to FIGS. 8 and 11, and as noted above, the cleaning device 100 may include a third receptacle (e.g., tray or compartment) 604 that can be configured to communicate with the second receptacle 620. The third receptacle 604 may be configured to receive the second receptacle 620 in a nesting relationship. The third receptacle 604 can be configured to removably (i.e., reversibly) nest and unnest with the first receptacle 104 and/or the second receptacle 620 and/or the base 102, according to aspects of the present disclosure. Accordingly, in aspects of the present disclosure, all three receptacles 104, 604, 620 can be configured to not only nest and unnest with one another, but also nest in and unnest from and be supported by the base 106. In an alternative aspect, the third receptacle 604 can be fixed in the base 106 to prevent easy removal of the third receptacle 604 therefrom.

In certain aspects of the present disclosure, a third receptacle 604 can be supported by and nested in the cavity 806 of the base 102. The third receptacle 604 may include a bottom portion 606 and a sidewall 608, both of which may, in combination, form a cavity 612. The bottom portion 606 and the sidewall 608 may be separate components or integral with one another. In an aspect of the present disclosure, the cavity 612 may be somewhat U-shaped or horseshoe shaped. In an aspect of the present disclosure, the cavity 612 may enable the third receptacle 604 to encircle (partially or completely) a motor housing 610 described below.

A person skilled in the art may determine any suitable shape and configuration for the third receptacle 604, as desired. In an aspect of the present disclosure, at least one leg may be disposed on an exterior surface of the third receptacle 604 and adapted to stabilize and secure the third receptacle 604 within the cavity 806 of the base 102. In another aspect of the present disclosure, a cylindrical opening 616 may be disposed in the sidewall 608 of the third receptacle 604 and adapted to receive the hose 108. A filter 618 may be disposed in the bottom portion 606 of the third receptacle 604 according to certain aspects of the disclosure. The filter 618 may be disposed in an opening or a recess with openings according to different aspects.

Referring to FIGS. 8 and 11, and as noted above, the cleaning device 100 may include a motor housing 610. The motor housing 610 may be disposed in the base 102 and/or in the second receptacle 640 and/or in the third receptacle 604, according to aspects of the present disclosure. The motor housing 610 may house a motor 846.

Figure 12:
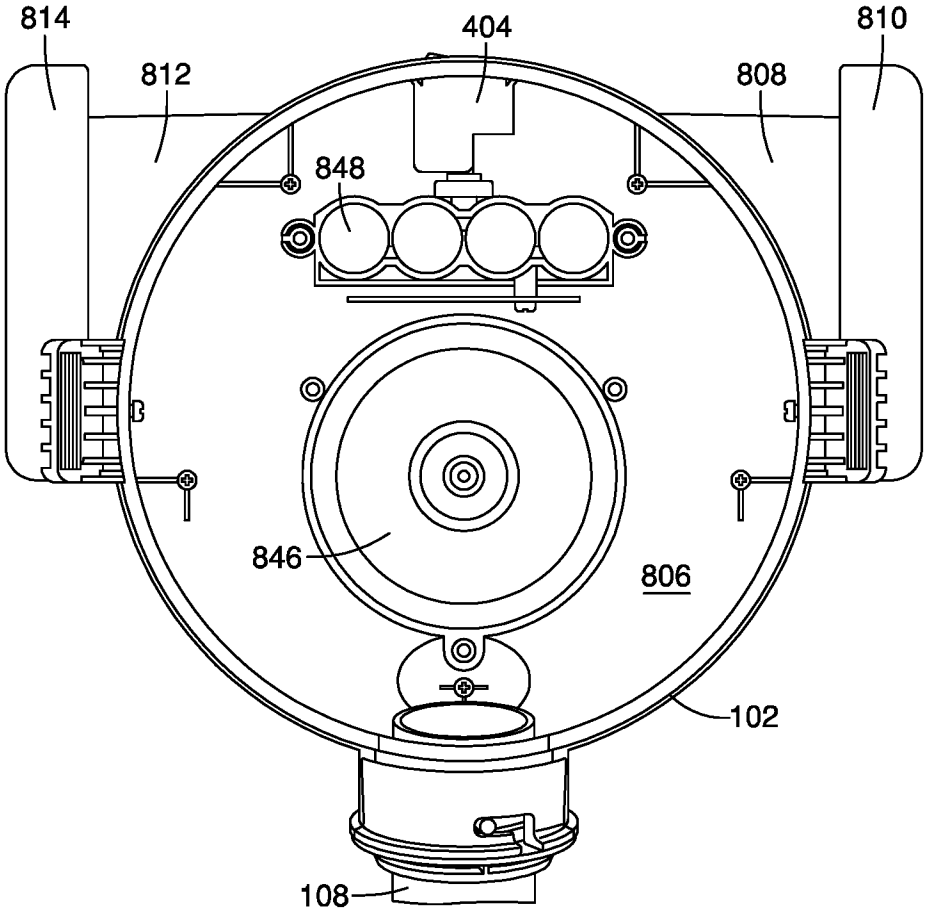
FIG. 12 is a top view of the base of the cleaning device of FIG. 1 with all receptacles and trays removed.

Referring to FIGS. 8 and 12, the motor 846 may be disposed in the base 102 and/or second receptacle 640 and/or in the third receptacle 604, according to aspects of the present disclosure. In certain aspects, the motor 846 is a suction motor. The motor 846 may be a series DC-motor that is adapted to operate on alternating current (AC) as well as on direct current (DC). The motor 846 may have high starting torque, operate at high speed, and be lightweight, according to certain aspects of the disclosure.

The motor 846 may have a suction power ranging from 1-2000 air watts according to certain aspects of the disclosure. In an aspect, the suction power may be in a range between 5 and 200 air watts. In another aspect, the suction power may be in a range between 10 and 100 air watts. In yet another aspect, the suction power may be in a range between 15 and 40 air watts. A person skilled in the art may select any suitable motor having a desirable suction power.

Referring to FIGS. 8 and 12, a power source 848 may be housed in the base 102 according to certain aspects of the present disclosure. The power source 848 may power the motor 846. In certain aspects, the power source 848 may include one or more batteries placed in a power source housing 850. The power source 848 may be rechargeable using a USB port, as a non-limiting example. Any suitable charging system may be used, as desired. In an alternative aspect of the present disclosure, the power source 848 may be a power cable (not shown) that plugs into a wall. In another aspect, the cleaning device 100 may operate using solar power. A person skilled in the art may select any suitable power source 848, as desired. The cleaning device 100 may include a low battery indicator and a charged battery indicator (not shown), according to certain aspects.

Referring to FIG. 8, in certain aspects of the present disclosure, the cleaning device 100 may include a counter 402. The counter 402 may be a digital counter disposed on the base 102 or the lid 106, as non-limiting examples. One skilled in the art may select any suitable counter 402 to include with the cleaning device 100.

Still in FIG. 8, the cleaning device 100 may also include a power switch 404, according to certain aspects of the disclosure. The power switch 404 may include one or more buttons capable of activating and deactivating the power source 848 and may be disposed on the base 102 or the lid 106 of the cleaning device 100, as non-limiting examples. A person skilled in the art may select any suitable power switch 404 or alternate means for activating and deactivating the power source 848.

In an exemplary use of the cleaning device 100, a user can turn on the power source 848 thereby activating the motor 846. The cleaning device 100 can use centripetal force to collect small and large objects/items from a floor or surface. As an example, small items may include dust and debris, and large items may include small toys such as jacks, marbles, and LEGO® bricks. The small and large items can travel along an airflow pathway that flows through the hose 108, the first receptacle 104, the second receptacle 620, and out the vent holes 1502 in the base 102.

In certain aspects, the diverter can direct the large items into the cavity 2402 of the lid 106 prior to the large items settling in the first receptacle 104. The plurality of openings 632 in the first receptacle 104 can prevent the large items from traveling along the airflow pathway through to the second receptacle 620 but can allow the small items to pass through. The small items may settle in the second receptacle 620 and may stick to the filter 618. Once all small and large items are picked up by the cleaning device 100, a user may turn off the power source 848 and observe how may large items were picked up by viewing the counter 402. The cleaning device 100 can sort the small and large items such that the large items are collected in an efficient, organized manner, and the small items can be quickly and easily discarded. Additionally, the large items may be cleaned of dirt and debris.

A user may empty the contents of the first receptacle 104 by removing the lid 106 or sliding the lid 106 into an open position and removing the first receptacle 104 from the base 102 of the cleaning device 100. The small items may be emptied by removing the second receptacle 620 from the base 102 of the cleaning device 100 and dumping the small items. Additionally, the filter 618 may be removed and replaced as needed. The hose 108 may be secured to the hose clamp 842 when not in use. In certain aspects, the hose 108 can be retractable and stored in the cavity 2402 of the lid 106 when not in use. The compact, lightweight, rectangular shape of the cleaning device 100 can allow for efficient storage in the home after use, as well as efficient packaging and distribution to stores and homes that purchase the cleaning device 100.

In certain aspects of the present disclosure, the semi-circular groove disposed in the sidewall 802 of the base 102 can receive the cylindrical opening 616 of the third receptacle 604. The connector 602 and the semi-cylindrical opening 644 in the main body 638 of the lid 106 may secure the third receptacle to the base 102. The connecting mechanism 650 of the hose 108 may connect to one or both of the groove 822 disposed in the sidewall 802 of the base 102 and the opening 616 of the third receptacle 604, and extend through or be flush with the opening 634 disposed in the sidewall 626 of the first receptacle 104. Each component is configured to ensure proper orientation of the cleaning device 100 after disassembly or partial disassembly.

Advantageously, damage to large items such as small toys can be prevented when using the cleaning device 100 due to optimal suction power and smooth, rounded surfaces in the hose 108, the lid 106, and the first receptacle 104. Typical cleaning devices are not configured to prevent damage to items being collected, as all the items are typically discarded.

The optimal amount of suction power can also allow the cleaning device 100 to be safely used by children. Likewise, the cordless aspect of the cleaning device 100 may also allow the cleaning device 100 to be safely used by children.

In addition to the optimal suction power and cordless design, various components of the cleaning device 100 may make it ideal for use by children. The lid 106 can be easy to open and remove, and the first receptacle 104 can be easy to remove and empty. The first receptacle 104 can be removed and emptied without removing the second receptacle 620 full of dirt and debris. Additionally, the components can intuitively go back together by lining up the parts around the hose 108. An auto-shutoff function can prevent the power source 848 from unnecessary use if a child forgets to turn off the cleaning device 100.

Children have fun and learn using the cleaning device 100. The diverter can send the large items spinning through the cavity 2402 of the lid 106 creating a fun display and engaging noise similar to a popcorn machine. The transparent hose 108 can allow children to see the items being collected by the cleaning device 100 and can permit easy detection of any blockages in the hose 108. The cleaning device 100 can teach children about cleaning but makes it fun. Children can learn about counting and numbers using the counter 402. The cleaning device 100 can be lightweight and small, thereby making it easy for a child to transport and maneuver.

The above-described aspects of the cleaning device 100 can effectively pick up and sort small and large items such that large items are cleaned of dirt and debris and can be saved for future use, and the small items can be discarded. Advantageously, the cleaning device 100 can be fun, engaging, educational, and easy and safe for children to use.

The present disclosure is not limited to the variations described, as it also covers all equivalent implementations insofar as they do not depart form the spirit of the disclosure. Further, the present disclosure is not yet limited to the combination of features as described herein but may be defined by any other combination of all the individual features disclosed. Further, the present disclosure is not yet limited to the sequence of method steps as described herein but may be defined by any other combination or order the steps disclosed. Any person skilled in the art will recognize from the previous detailed description and from the claims that modifications could be made to the disclosed embodiments of the present disclosure without departing from the scope of the disclosure.

The invention claimed is:

1. A cleaning device, comprising:

a base;

a suction motor positioned within the base;

a hose engageable with the base so as to be in communication with the suction motor thereby enabling the hose to capture one or more of an at least one first object, an at least one second object, and trash and dust outside and move said one or more of the at least one first object, the at least one second object, and the trash and dust into the base, wherein the at least one first object is larger than the at least one second object, and the at least one second object is larger than the trash and dust;

a first tray positioned within the base between the hose and the suction motor, the first tray providing an at least one first tray opening having a first size configured to prohibit the at least one first object to pass therethrough and allow the at least one second object, along with the trash and dust, to pass therethrough;

a second tray positioned within the base nested under the first tray, the second tray providing an at least one second tray opening having a second size that is smaller than the first size and configured to prohibit the at least one second object to pass therethrough and allow the trash and dust to pass therethrough;

a third tray positioned within the base, under the second tray, and configured to nest with the first and the second tray; and wherein the second tray is horseshoe-shaped across a horizontal plane and horizontally encircles a housing of the suction motor;

whereby, during use of the cleaning device, as the hose captures one or more of the at least one first object, the at least one second object, and the trash and dust outside of the base, each of the at least one first object is retained within the first tray, each of the at least one second object is retained within the second tray, and each of the trash and dust is retained within the third tray.

2. The cleaning device of claim 1, wherein the second tray is further configured to nest in the third tray.

3. The cleaning device of claim 1, wherein the first tray, the second tray and the third tray are further configured to unnest from one another.

4. The cleaning device of claim 1, further comprising a lid configured for removable engagement with the base for selectively enclosing each of the first tray, the second tray, and the third tray within the base.

5. The cleaning device of claim 4, wherein the lid is further configured in the shape of a dome.

6. The cleaning device of claim 1, wherein at least two of the first tray, the second tray and the third tray are fabricated from a plastic material.

7. A cleaning device comprising:

a base;

a suction motor positioned within the base;

a hose engageable with the base so as to be in communication with the suction motor, thereby enabling the hose to capture one or more of an at least one first object, an at least one second object, and trash and dust outside of the base and move said one or more of the at least one first object, the at least one second object, and the trash and dust into the base, wherein the at least one first object is larger than the at least one second object, and the at least one second object is larger than the trash and dust;

a first tray positioned within the base between the hose and the suction motor, the first tray providing an at least one first tray opening having a first size configured to prohibit the at least one first object to pass therethrough and allow the at least one second object, along with the trash and dust, to pass therethrough;

a second tray positioned within the base nested under the first tray, the second tray providing an at least one second tray opening having a second size that is smaller than the first size and configured to prohibit the at least one second object to pass therethrough and allow the trash and dust to pass therethrough;

a third tray positioned within the base, under the second tray, and configured to nest with the first tray and the second tray;

wherein the second tray is horseshoe-shaped across a horizontal plane and horizontally encircles a housing of the suction motor; and a lid configured for removable engagement with the base for selectively enclosing each of the first tray, the second tray, and the third tray within the base;

whereby, during use of the cleaning device, as the hose captures one or more of the at least one first object, the at least one second object, and the trash and dust outside of the base, each of the at least one first object is retained within the first tray, each of the at least one second object is retained within the second tray, and each of the trash and dust is retained within the third tray.

8. The cleaning device of claim 7, wherein the first tray, the second tray, and the third tray are further configured to unnest from one another.

9. The cleaning device of claim 7, wherein the hose is in vacuum communication with the lid, the first tray, the second tray, and the base.

10. The cleaning device of claim 7, further comprising: a filter in the second tray.

11. The cleaning device of claim 7, further comprising: at least one wheel attached to the base.

12. The cleaning device of claim 7, wherein the lid is further configured in the shape of a dome.

13. The cleaning device of claim 7, wherein at least two of the first tray, the second tray and the third tray are fabricated from a plastic material.

14. A cleaning device, comprising:

a base;

a plurality of wheels positioned on a bottom portion of the base, such that the bottom portion of the base is spaced a distance above a surface on which the cleaning device is positioned;

a suction motor positioned within the base and in communication with an at least one vent hole positioned within the bottom portion of the base, thereby allowing the suction motor to discharge air from the base via the at least one vent hole;

a hose engageable with the base so as to be in communication with the suction motor, thereby enabling the hose to capture one or more of an at least one first object, an at least one second object, and trash and dust outside of the base and move said one or more of the at least one first object, the at least one second object, and the trash and dust into the base, wherein the at least one first object is larger than the at least one second object, and the at least one second object is larger than the trash and dust;

a first tray positioned within the base between the hose and the suction motor, the first tray providing an at least one first tray opening having a first size configured to prohibit the at least one first object to pass therethrough and allow the at least one second object, along with the trash and dust, to pass therethrough;

a second tray positioned within the base nested under the first tray, the second tray providing an at least one second tray opening having a second size that is smaller than the first size and configured to prohibit the at least one second object to pass therethrough and allow the trash and dust to pass therethrough;

a third tray positioned within the base, under the second tray, and configured to nest with the first tray and the second tray;

wherein the second tray is horseshoe-shaped across a horizontal plane and horizontally encircles a housing of the suction motor; and a lid configured for removable engagement with the base for selectively enclosing each of the first tray, the second tray and the third tray within the base;

whereby, during use of the device, as the hose captures one or more of the at least one first object, the at least one second object, and the trash and dust outside of the base, each of the at least one first object is retained within the first tray, each of the at least one second object is retained within the second tray, and each of the trash and dust is retained within the third tray.

* * * * *